US009874836B1

(12) United States Patent
Kitajima et al.

(10) Patent No.: US 9,874,836 B1
(45) Date of Patent: Jan. 23, 2018

(54) IMAGE FORMING APPARATUS USING A DEVELOPER CONTAINING A SPECIFIC TONER

(71) Applicant: FUJI XEROX CO., LTD., Tokyo (JP)

(72) Inventors: Katsuyuki Kitajima, Kanagawa (JP); Naoki Ota, Kanagawa (JP); Masataka Kuribayashi, Kanagawa (JP); Takafumi Koide, Kanagawa (JP); Yusuke Fukuda, Kanagawa (JP); Yasuhisa Morooka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/420,758

(22) Filed: Jan. 31, 2017

(30) Foreign Application Priority Data

Jul. 1, 2016 (JP) ..... 2016-132009

(51) Int. Cl.
*G03G 15/01* (2006.01)
*G03G 15/16* (2006.01)

(52) U.S. Cl.
CPC ..... *G03G 15/161* (2013.01)

(58) Field of Classification Search
CPC ..... G03G 15/161; G03G 15/1605; G03G 15/165; G03G 9/0819
USPC ..... 399/223, 252, 298, 302; 430/109.4
See application file for complete search history.

(56) References Cited

U.S. PATENT DOCUMENTS 8,431,301 B2 * 4/2013 Ninomiya et al. ... G03G 9/0819 430/109.4
2009/0233210 A1 9/2009 Ninomiya et al.
2016/0266507 A1 * 9/2016 Watanabe et al. ... G03G 9/0819

FOREIGN PATENT DOCUMENTS

JP 2009-223055 A 10/2009

* cited by examiner

*Primary Examiner* — William J Royer
(74) *Attorney, Agent, or Firm* — Oliff PLC

(57) ABSTRACT

An image forming apparatus includes an image holding member, a developing unit that contains a developer containing toner particles and develops an electrostatic latent image formed on a surface of the image holding member with the developer to form a toner image, a primary transfer unit that transfers the toner image formed on the image holding member to an intermediate transfer member, a second transfer unit that transfers the toner image transferred on the intermediate transfer member to a recording medium, and a guide unit that guides at least one of the image holding member and the intermediate transfer member to a primary transfer position such that a portion of the image holding member and a portion of the intermediate transfer member are disposed along with each other, wherein the specific toner defined in the specification is used.

8 Claims, 2 Drawing Sheets

IMAGE FORMING APPARATUS USING A DEVELOPER CONTAINING A SPECIFIC TONER

CROSS-REFERENCE TO RELATED APPLICATIONS

This application is based on and claims priority under 35 USC 119 from Japanese Patent Application No. 2016-132009 filed Jul. 1, 2016.

BACKGROUND

1. Technical Field

The present invention relates to an image forming apparatus.

2. Related Art

Image forming by using an electrophotographic method is performed in such a manner that the entire surface of a photoreceptor is charged, the surface of the photoreceptor is exposed to a laser beam according to image information data so as to form an electrostatic latent image, subsequently, the electrostatic latent image is developed by using a developer including a toner to form a toner image, and subsequently the toner image is transferred to a surface of a recording medium, followed by fixing.

SUMMARY

According to an aspect of the invention, there is provided an image forming apparatus including:

an image holding member;

a charge unit that charges a surface of the image holding member;

an electrostatic latent image forming unit that forms an electrostatic latent image on a charged surface of the image holding member;

a developing unit that contains a developer containing toner particles, and develops the electrostatic latent image formed on the surface of the image holding member with the developer to form a toner image;

an intermediate transfer member of which the toner image is to be transferred to a surface;

a primary transfer unit that primarily transfers the toner image formed on the surface of the image holding member to the surface of the intermediate transfer member;

a second transfer unit that secondarily transfers the toner image transferred on the surface of the intermediate transfer member to a surface of a recording medium; and a guide unit that is provided on an upstream in the rotation direction of the intermediate transfer member from the primary transfer unit, and guides at least one of the image holding member and the intermediate transfer member to a primary transfer position provided by the primary transfer unit such that a portion of the surface of the image holding member and a portion of the surface of the intermediate transfer member are disposed along with each other, wherein the toner particles contain a binder resin containing a crystalline polyester resin, a colorant and a release agent, and have an average circularity in a range of 0.955 to 0.971, a content ratio of the toner particles having a particle diameter of 4.5 μm or more and less than 7.5 μm and a circularity of 0.980 or more is in a range of 16% by number to 40% by number, and a content ratio of the toner particles having a particle diameter of 7.5 μm or more and less than 15 μm and a circularity of 0.900 or more and less than 0.940 is 3% by number or less.

BRIEF DESCRIPTION OF THE DRAWINGS

Exemplary embodiments of the present invention will be described in detail based on the following figures, wherein.

DETAILED DESCRIPTION

Figure 1:
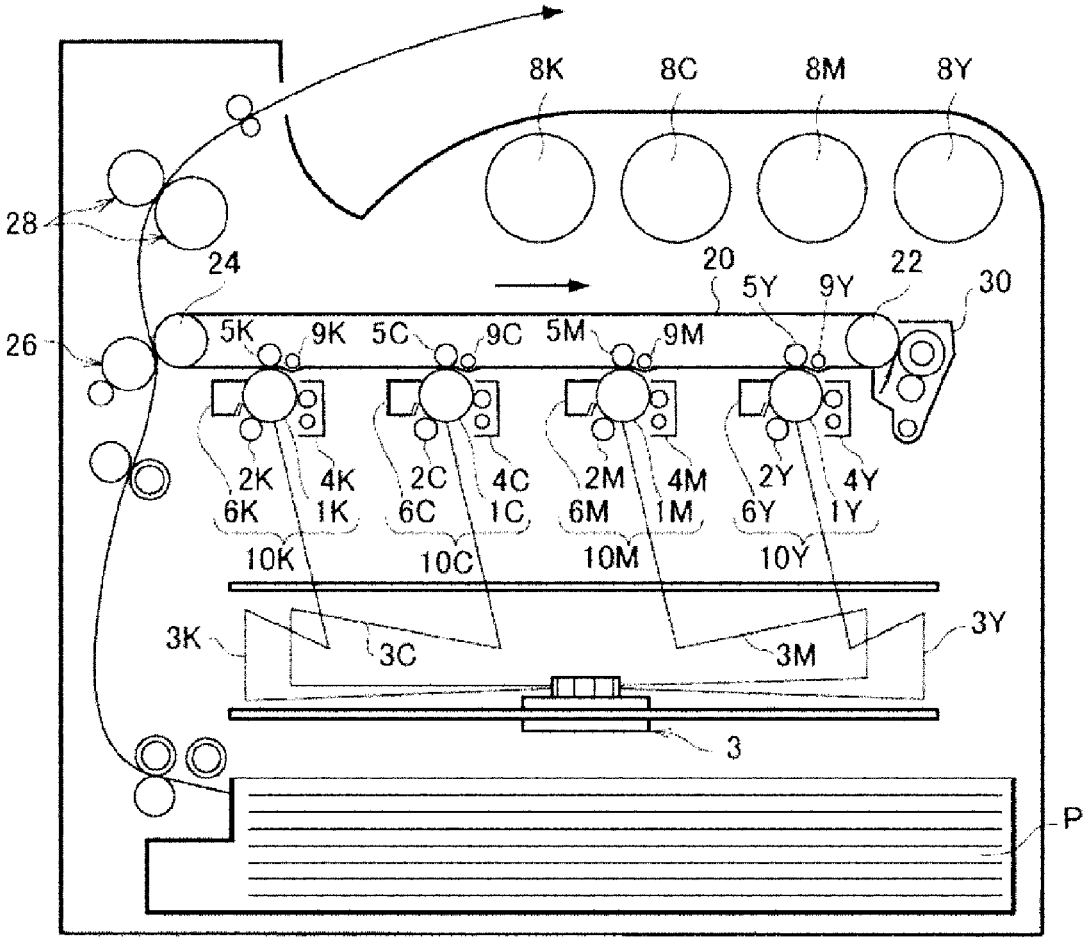
FIG. 1 illustrates the structure of an image forming apparatus according to an exemplary embodiment of the present invention.

Hereinafter, the exemplary embodiment which is an example of the invention will be described in detail.

Image Forming Apparatus

An image forming apparatus according to an exemplary embodiment includes an image holding member; a charge unit that charges a surface of the image holding member; an electrostatic latent image forming unit that forms an electrostatic latent image on the surface of the charged image holding member; a developing unit that contains a developer containing a specific toner described later, and develops the electrostatic latent image formed on the surface of the image holding member with the developer so as to form a toner image; an intermediate transfer unit that transfers the toner image to a surface of a recording medium; a primary transfer unit that primarily transfers the toner image formed on the image holding member to the surface of the intermediate transfer member; a second transfer unit that secondarily transfers the toner image transferred to the surface of the intermediate transfer member to a surface of a recording medium; and a guide unit that is provided on the upstream in the rotation direction of the intermediate transfer member from the primary transfer unit, and guides at least one of the image holding member and the intermediate transfer member up to a primary transfer position by the primary transfer unit such that a portion of the surface of the image holding member and a portion of the surface of the intermediate transfer member are disposed along with each other.

In the intermediate transfer-type image forming apparatus of the related art, discharge is generated on the upstream of the primary transfer position, and thus the toner on the image holding member is scattered to the intermediate transfer member in some cases. From the aspect that that toner is prevented from being scattered at the time of the primary transfer, before the primary transfer, that is, before applying a primary transfer voltage, the guide unit that guides the image holding member on which the toner image is formed and the intermediate transfer member via the toner image is provided to be disposed along with each other, which is well-known.

In the image forming apparatus including such a guide unit, the image holding member and the intermediate transfer member contact with each other via toner image during the time between the primary transfer and before the primary transfer.

In the image forming apparatus including the guide unit, the contact time between the intermediate transfer member and the toner image is long as compared with a case of not including the guide unit, and the influence of the non-electrostatic adhesion such as a Van der Waals force (intermolecular force) of the toner with respect to the surface of the image holding member is increased. For this reason, it is likely that the toner image is attached to the surface of the image holding member and the transfer properties of the toner image which is transferred to the intermediate transfer member are decreased.

In contrast, the image forming apparatus according to the exemplary embodiment is an image forming apparatus which includes a developer containing the specific toner as described below.

The specific toner includes toner particles which contain a binder resin containing a crystalline polyester resin, a colorant, and a release agent, and the toner particles have an average circularity of 0.955 to 0.971, the content ratio of the toner particles having a particle diameter of 4.5 μm or more and less than 7.5 μm and a circularity of 0.980 or more is in a range of 16% by number to 40% by number, and the content ratio of the toner particles having a particle diameter of 7.5 μm or more and less than 15 μm and a circularity of 0.900 or more and less than 0.940 is 3% by number or less.

With respect to the specific toner, while the toner particles have an average circularity falling within the above range, the content ratio of the toner particles having a coarse particle diameter and a low circularity is small, and the content ratio of the toner particles having a small diameter and almost spherical shape is large. In the image forming apparatus according to exemplary embodiment, the transfer properties of the toner image transferred to the intermediate transfer member from the image holding member are prevented from being deteriorated by using the specific toner satisfying the above-described condition range. Although the reason is not clear, the following reasons may be presumed.

Regarding the toner, as the particle diameter of the toner becomes smaller, the van der Waals force on the surface of the image holding member is increased, whereas as the shape of the toner is formed into almost a spherical shape, the van der Waals force may be decreased.

As described above, the specific toner includes toner particles having a coarse particle diameter and a low circularity in a small amount, and the toner particles having a small particle diameter and being formed into an almost spherical shape in a large amount, with respect to the above-described range of the average circularity. The specific toner has a shape peculiar to a specific toner, and thus Van der Waals force of the entire specific toner tends to be decreased, and Van der Waals force of a toner image formed with the specific toner is also decreased. As a result, non-electrostatic adhesion with respect to the surface of the image holding member of the toner image is weakened, and thus the transfer properties of the toner image formed by using the specific toner with respect to the intermediate transfer member are improved. Accordingly, it is considered that the transfer properties are prevented from being deteriorated even in a case where an image is formed by the image forming apparatus which includes the guide unit in which the contact time between the intermediate transfer member and the toner image becomes long.

As described above, in the image forming apparatus according to the exemplary embodiment, the transfer properties of the toner image transferred to the intermediate transfer member from the image holding member are prevented from being deteriorated by using the specific toner.

With the image forming apparatus including the above-described guide unit, the toner is also prevented from being scattered at the time of primary transfer, and a high quality image may also be formed.

Furthermore, in a case where the average circularity is in the above-described range, for example, it is possible to prevent the granularity from being deteriorated.

In the image forming apparatus according to the exemplary embodiment, an image forming method is performed, and the method includes a step of charging a surface of an image holding member; an electrostatic latent image step of forming an electrostatic latent image on the charged image holding member; a step of developing the electrostatic latent image formed on the surface of the image holding member with a developer containing the specific toner so as to form a toner image; a primary transfer step of primarily transferring the toner image formed on the image holding member to the surface of the intermediate transfer member; a second transfer step of secondarily transferring the toner image transferred to the surface of the intermediate transfer member to a surface of a recording medium; a step of guiding the image holding member and the intermediate transfer member up to a primary transfer position provided by the primary transfer unit before the primary transfer step such that a portion of the surface of the image holding member on which the toner image is formed and a portion of the surface of the intermediate transfer member are disposed along with each other via the toner image.

Configuration of Image Forming Apparatus

As the image forming apparatus according to the exemplary embodiment, well-known image forming apparatuses such as an apparatus including fixing unit that fixes a toner image transferred on a surface of a recording medium; an apparatus includes an erasing unit that erases charges by irradiating the surface of the image holding member with erasing light after transferring the toner image and before being charged; an apparatus including a cleaning unit that cleans the surface of the image holding member after transferring the toner image and before being charged; and an apparatus including an image holding member-heating material that increases the temperature of the image holding member so as to decrease a relative temperature are employed.

In the image forming apparatus according to the exemplary embodiment, for example, a unit including the image holding member may be a cartridge structure (process cartridge) which is detachable from the image forming apparatus. In addition to the image holding member, examples of the process cartridge include at least one selected from the group consisting of a charge unit, an electrostatic latent image forming unit, and a developing unit may be included in the process cartridge.

Hereinafter, an example of the image forming apparatus of the exemplary embodiment will be described; however, the invention is not limited thereto. Note that, in the drawing, major portions will be described, and others will not be described.

FIG. 1 illustrates the structure of an image forming apparatus according to an exemplary embodiment.

The image forming apparatus as illustrated in FIG. 1 has four electrophotographic image forming units 10Y, 10M, 10C, and 10K (image forming unit) that output an image for each color of yellow (Y), magenta (M), cyan (C), and black (K) based on color separated image data. These image forming units 10Y, 10M, 10C, and 10K (hereinafter, simply referred to as a "unit" in some cases) are arranged apart from each other by a predetermined distance in the horizontal direction. The units 10Y, 10M, 10C, and 10K may be the process cartridge which is detachable from the image forming apparatus.

As an intermediate transfer member, an intermediate transfer belt 20 passing through the respective units is extended upward in the drawing of the respective units 10Y, 10M, 10C, and 10K. The intermediate transfer belt 20 is provided to be wound onto a support roller 24 which contacts with the inner surface of an intermediate transfer belt 20 and a driving roller 22, which are disposed apart from each other in the horizontal direction in the drawing, and travels to the direction from the first unit 10Y to the fourth unit 10K. In addition, a force is applied to the support roller 24 in the direction apart from the driving roller 22 by a spring (not shown), and thus a tension is applied to the intermediate transfer belt 20 which is wound onto both. Further, an intermediate transfer member cleaning device 30 is provided on the side surface of the image holding member of the intermediate transfer belt 20 so as to face the driving roller 22.

Each of developing devices (an example of the developing unit) 4Y, 4M, 4C, and 4K of the each of the units 10Y, 10M, 10C, and 10K contains the developer containing the toner. In addition, four colors toner of yellow, magenta, cyan, and black stored in toner cartridges 8Y, 8M, 8C, and 8K are correspondingly supplied to each of the developing devices 4Y, 4M, 4C, and 4K.

The first to fourth units 10Y, 10M, 10C, and 10K have the same configuration as each other, and thus the first unit 10Y for forming a yellow image disposed on the upstream side the travel direction of the intermediate transfer belt 20 will be representatively described. Note that, the description for the second to fourth units 10M, 10C, and 10K will be omitted by denoting reference numeral with magenta (M), cyan (C), and black (K) instead of yellow (Y) to the same part as that of the first unit 10Y.

The first unit 10Y has a photoreceptor 1Y acting as an image holding member.

Around the photoreceptor 1Y, a charging roller (an example of the charge unit) 2Y that charges a surface of the photoreceptor 1Y to a predetermined potential; an exposure device (an example of the electrostatic latent image forming unit) 3 that exposes the charged surface with laser beams 3Y based on a color-separated image signal to form an electrostatic latent image; a developing device (an example of the developing unit) 4Y that supplies a charged toner to the electrostatic latent image, and develops the electrostatic latent image so as to form a toner image; a guide roller (an example of the guide unit) 9Y that guides a portion of a surface of an image holding member on which a toner image is formed and a portion of a surface of an intermediate transfer belt 20 to be disposed along with each other via the toner image; a primary transfer roller 5Y (an example of the primary transfer unit) that applies a primarily transfer voltage, and primarily transfers the toner image, which is interposed between the photoreceptor 1Y and the intermediate transfer belt 20, onto the intermediate transfer belt 20; and a photoreceptor cleaning device (an example of the cleaning unit) 6Y that removes a residue remaining on the surface of the photoreceptor 1Y after the primary transfer are sequentially disposed.

The primary transfer roller 5Y is disposed inside the intermediate transfer belt 20, and is provided at a position facing the photoreceptor 1Y. Further, bias power supply (not shown) which applies the primary transfer voltage is connected to each of the primary transfer rollers 5Y, 5M, 5C, and 5K. The bias power supply changes the primary transfer voltage which is applied to the primary transfer roller by control of a control unit (not shown).

The guide roller 9Y is disposed inside the intermediate transfer belt 20, and guides a portion of the surface of the intermediate transfer belt 20 such that the portion of the surface of the intermediate transfer belt 20 faces a portion of the surface of the photoreceptor 1Y by deforming a portion of the intermediate transfer belt 20.

Figure 2:
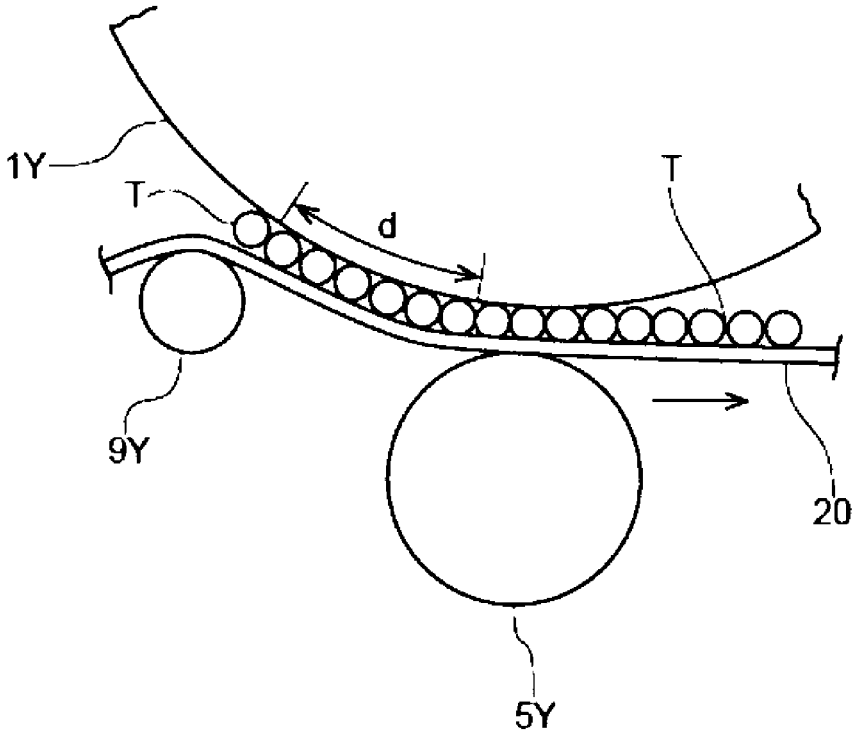
FIG. 2 illustrates the structure of a state of disposition of a guide unit in the exemplary embodiment.

Here, an example of a state of disposition of the guide unit will be more specifically described with reference to FIG. 2. FIG. 2 illustrates the structure of a state of disposition of the guide roller 9Y in the image forming unit 10Y.

As illustrated in FIG. 2, the guide roller 9Y is disposed on the upstream side of the primary transfer roller 5Y on the upstream side (upstream side in the arrow direction in FIG. 2) of the intermediate transfer belt 20 in the rotation direction, and deforms the intermediate transfer belt 20 such that the intermediate transfer belt 20 is disposed along with a portion of the circumstance of the photoreceptor 1Y. In this case, the developed toner image T is interposed between the photoreceptor 1Y and the intermediate transfer belt 20, and the heat from the intermediate transfer belt 20 is transferred to the toner image T.

Here, a distance in which a portion of the surface of the photoreceptor 1Y and a portion of the surface of the intermediate transfer belt 20 are disposed along with each other (d in FIG. 2: a distance in which the surface of the photoreceptor 1Y and the intermediate transfer belt 20 contact with each other via the toner image T, namely, a distance to a pressure-contacting part (the primary transfer position) by the transfer roller 5Y) may be determined depending on rotational speed of the photoreceptor 1Y, the outer diameter of the photoreceptor 1Y, and the like, but is preferably 5 mm or more, and is more preferably from 5 mm to 10 mm.

In the exemplary embodiment, all four units 10Y, 10M, 10C, and 10K have a guide unit (guide rollers 9Y, 9M, 9C, and 9K), and the units including such a guide unit may employ a developer containing the specific toner as the developer contained in the developing device.

Hereinafter, an operation of forming a yellow image in the first unit 10Y will be described.

First, before starting the operation, the surface of the photoreceptor 1Y is charged with the potential in a range of −600 V to −800 V by the charging roller 2Y.

The photoreceptor 1Y is formed by laminating a photosensitive layer on a conductive substrate (for example, volume resistivity: $1\times10^{-6}$ Ωcm at 20° C.). This photosensitive layer is normally high resistance (general resin resistance), but when being irradiated with the laser beam 3Y, the photoreceptor 1Y has the properties of changing the resistivity of a portion which is irradiated with the laser beam. In this regard, in accordance with image data for yellow transmitted from the control unit (not shown), the laser beam 3Y is output to the charged surface of the photoreceptor 1Y via the exposure device 3. The photosensitive layer on the surface of the photoreceptor 1Y is irradiated with the laser beam 3Y, and thereby, the electrostatic latent image of a yellow image pattern is formed on the surface of the photoreceptor 1Y.

The electrostatic latent image means an image formed on the charged surface of the photoreceptor 1Y, in which resistivity of a portion of the photosensitive layer to be irradiated with the laser beam 3Y is decreased and the charges for charging the surface of the photoreceptor 1Y move; while charges of a portion which is not irradiated with the laser beam 3Y remain, namely the electrostatic latent image is a so-called negative latent image.

The electrostatic latent image formed on the photoreceptor 1Y is rotated to the predetermined developing position in accordance with the traveling of the photoreceptor 1Y. Further, at the developing position, the electrostatic latent image on the photoreceptor 1Y is visualized (developed) as a toner image by the developing device 4Y.

The developing device 4Y contains, for example, a developer including at least a yellow toner and a carrier. The yellow toner is frictionally charged by being agitated in the developing device 4Y to have a charge with the same polarity (negative polarity) as the charge that is charged on the photoreceptor 1Y, and is thus held on a developer roll (an example of a developer holding member). By allowing the surface of the photoreceptor 1Y to pass through the developing device 4Y, the yellow toner electrostatically adheres to the erased latent image part on the surface of the photoreceptor 1Y, so that the latent image is developed with the yellow toner. The photoreceptor 1Y on which the yellow toner image is formed is subsequently driven at a predetermined speed. In addition, the toner image developed on the photoreceptor 1Y contacts with the intermediate transfer belt 20 which is deformed by the guide roller 9Y, and subsequently transported to the predetermined primary transfer position (a pressure-contacting part (a nip portion) by the transfer roller 5Y).

When the yellow toner image on the photoreceptor 1Y is transported to the primary transfer position, a primary transfer bias is applied to the primary transfer roller 5Y and an electrostatic force toward the primary transfer roller 5Y from the photoreceptor 1Y acts on the toner image, so that the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed by a photoreceptor cleaning device 6Y to be collected.

The primary transfer voltages that are applied to the primary transfer rollers 5M, 5C, and 5K of the second unit 10M and the subsequent units are also controlled in the same manner as in the case of the first unit 10Y.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the four units reaches a secondary transfer part that is composed of the intermediate transfer belt 20, the support roller 24 contacting the inner surface of the intermediate transfer belt 20, and a secondary transfer roller (an example of the secondary transfer unit) 26 disposed on the image holding surface side of the intermediate transfer belt 20.

Meanwhile, a recording sheet (an example of the recording medium) P is supplied to a gap between the secondary transfer roller 26 and the intermediate transfer belt 20 by a supply mechanism at a predetermined timing, and a secondary transfer bias is applied to the support roller 24. The transfer bias applied at this time has the same polarity (−) as the toner polarity (−), and an electrostatic force toward the recording sheet P from the intermediate transfer belt 20 acts on the toner image, so that the toner image on the intermediate transfer belt 20 is transferred onto the recording sheet P. In this case, the secondary transfer bias is determined depending on the resistance detected by a resistance detecting unit (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, so that a fixed image is formed. Examples of the recording sheet P to which the toner image is transferred include plain paper that is used in electrophotographic copying machine, printers, and the like, and as a recording medium, an OHP sheet is also exemplified other than the recording sheet P.

The recording sheet P on which the fixing of the color image is completed is discharged toward a discharge part, and a series of the color image forming operations end.

Here, in FIGS. 1 and 2, an example of including a drum (cylindrical)-shaped photoreceptor (an example of the image holding member), and a belt-shaped intermediate transfer member is described; however, the exemplary embodiment is not limited to the example.

For example, the belt-shaped photoreceptor and the drum-shaped intermediate transfer member may be combined with each other, and the belt-shaped photoreceptor and the belt-shaped intermediate transfer member may be combined with each other.

In a case of the former, the guide unit may deform the belt-shaped photoreceptor so as to be disposed along with the circumference of the drum-shaped intermediate transfer member.

In addition, in a case of the latter, the guide unit deforms at least one of the belt-shaped photoreceptor and the belt-shaped intermediate transfer member such that the circumference of the belt-shaped photoreceptor and the circumference of the belt-shaped intermediate transfer member are disposed along with each other.

Next, the components (the image holding member, the charge unit, the electrostatic latent image forming unit, the developing unit, the primary and secondary transfer units, the intermediate transfer member, and the developer) for constituting the image forming apparatus according to the exemplary embodiment will be specifically described.

Note that, the description is made without reference numerals.

Image Holding Member

As the photoreceptor in the exemplary embodiment, a well-known image holding member is employed.

The photoreceptor may be formed into a drum (cylindrical) shape as illustrated FIGS. 1 and 2, or may be formed into a belt shape.

The photoreceptor includes a photosensitive layer on the outer peripheral surface of the conductive substrate, and if necessary, it may also include an undercoat layer provided between the conductive substrate and the photosensitive layer, an intermediate layer provided between the undercoat layer and the photosensitive layer, and a protective layer provided on the surface of the photosensitive layer, in addition to the photosensitive layer.

Further, the photosensitive layer may be a function separation-type (a multi-layer type) photosensitive layer including a charge generation layer having charge generation capability and a charge transport layer having charge transport capability, or may be a function integrated-type (a single layer type) photosensitive layer having the charge generation capability and the charge transport capability.

Charge Unit

In the image forming apparatus as illustrated in FIG. 1, the charging rollers 2Y, 2M, 2C, and 2K are used as the charge unit; however, the charge unit is not limited to the charging rollers.

Other examples of the charge unit include a contact-type charging device using a conductive or semiconductive charging brush, a charging film, a charging rubber blade, a charging tube or the like.

In addition, well-known charger such as a non-contact type roller charger a scorotron charger using corona discharge and a corotron charger are also used.

Electrostatic Latent Image Forming Unit

In the image forming apparatus as illustrated in FIG. 1, the exposure device 3 which may emit the laser beams 3Y, 3M, 3C, and 3K is used as the electrostatic latent image forming unit; however, the electrostatic latent image forming unit is not limited to the above exposure device.

Examples of the exposure device include an optical device that exposes the surface of the electrophotographic photoreceptor in a predetermined image with the light such as a semiconductor laser beam, LED light, and liquid crystal shutter light. The wavelength of the light source is set to be within a spectral sensitivity region of the electrophotographic photoreceptor. The wavelength of the semiconductor laser beam is mainly near-infrared having an oscillation wavelength in the vicinity of 780 nm. However, the wavelength is not limited, the oscillation wavelength laser having a level of 600 nm, or laser having the oscillation wavelength in a range of 400 nm to 450 nm as a blue laser may be also used. In addition, a surface emission-type laser light source capable of outputting a multi-beam is also effective to form a color image.

Developing Unit

Examples of the developing unit (a developing device) include a typical developing device that develops an image by bringing a developer into contact with or not in contact with the image holding member.

Examples of the developing unit include general developing devices that develop an image by bringing a developer into contact with or not in contact with the image holding member. The example of the developing device is not particularly limited as long as it has the above-described functions, and the type thereof is selected depending on the purpose. For example, examples thereof include a well-known developing device having a function of attaching a one-component developer or a two-component developer to the electrophotographic photoreceptor by using a brush, a roller, and the like. Among them, it is preferable to use a developing roller which holds the developer on the surface.

Here, the developer used in the developing unit may be the one-component developer of only a specific toner described later, and may be the two component developer including the specific toner and the carrier. In addition, the developer may be magnetic or non-magnetic.

Guide Unit

As the guide unit, the guide rollers 9Y, 9M, 9C, and 9K which are disposed inside the intermediate transfer belt 20 are used in the image forming apparatus as illustrated in FIG. 1; however, the guide unit is not limited thereto.

In addition, the shape of the guide unit is not limited to a roll shape, and examples thereof include a plate shape and an arc shape.

As described above, the guide unit may guide the photoreceptor and the intermediate transfer member to be disposed along with each other by deforming at least one of the photoreceptor and the intermediate transfer member before the primary transfer, and thus the position of the guide unit may be determined in accordance with the shape of the photoreceptor and the intermediate transfer member. The position of the guide unit is not limited to the inside of the intermediate transfer member, but may be disposed inside the photoreceptor, or may be disposed both of the inside of the intermediate transfer member and the inside of the photoreceptor.

The above guide unit is provided so as to prevent the toner from being scattered at the time of the primary transfer, and the image forming apparatus according to the exemplary embodiment may be provided with a guide unit having the same configuration so as to prevent the toner from being scattered at the time of the secondary transfer.

Primary and Secondary Transfer Units

In the image forming apparatus as illustrated in FIG. 1, the intermediate transfer type device using the intermediate transfer belt 20 is employed as the primary and secondary transfer units, and the primary transfer rollers 5Y, 5M, 5C, and 5K, and the secondary transfer roller 26 are used; however, the transfer unit is not limited to the intermediate transfer type device.

Other examples of the primary and secondary transfer units include a transfer unit which utilizes a direct transfer method using transfer corotron, a transfer roller, or the like, or a transfer belt method for electrostatically adsorbing and transporting a recording medium and transferring the toner image present on the photoreceptor.

Examples of the primary and secondary transfer units include well-known transfer charger such as a contact type transfer charger using a belt, a film, a rubber blade, and the like in addition to the roller, a scorotron transfer charger using corona discharge, and a corotron transfer charger are also used.

Intermediate Transfer Member

As the intermediate transfer member, the intermediate transfer belt 20 is used in the image forming apparatus as illustrated in FIG. 1, but the exemplary embodiment is not limited thereto.

Other examples of the intermediate transfer member include a drum-shaped intermediate transfer member.

For an intermediate transfer belt, usable are those containing polyimide, polyamideimide, polycarbonate, polyarylate, polyester, rubber, or the like, to which semi-conductivity is imparted.

Developer Containing Specific Toner

The developer contained in the image forming apparatus according to the exemplary embodiment contains the specific toner as described below.

First, the specific toner will be described.

The specific toner contains toner particles containing a binder resin, a colorant, and the release agent, and the binder resin contains a crystalline polyester resin.

In addition, in the specific toner, the content ratio of toner particles having the average circularity in a range of 0.955 to 0.971, the particle diameter of 4.5 μm or more and less than 7.5 μm, and the circularity of 0.980 or more is in a range of 16% by number to 40% by number, and the content ratio of the toner particles having the particle diameter of 7.5 μm or more and less than 15 μm and the circularity of 0.900 or more and less than 0.940 is 3% by number or less.

Hereinafter, the specific toner will be specifically described.

As described above, the specific toner satisfies that the content ratio of the toner particles having the particle diameter of 4.5 μm or more and less than 7.5 μm, and the circularity of 0.980 or more is in a range of 16% by number to 40% by number. This condition (hereinafter, also referred to as "M ratio") means that the toner particles having the high circularity (almost spherical shape) are present at a specific ratio in the vicinity of the center of the particle diameter distribution of the toner particles.

Further, the specific toner satisfies that the content ratio of the toner particles having the particle diameter of 7.5 μm or more and less than 15 μm, and the circularity of 0.900 or more and less than 0.940 is 3% by number or less. This condition (hereinafter, also referred to as "L ratio") means that the toner particles having the low circularity (with unevenness) are present at equal to or less than the specific ratio on the coarse side of the particle diameter distribution of the toner particles.

From the aspect that the specific toner prevents the transfer properties of the toner image transferred to the intermediate transfer member from the image holding member from being deteriorated, the content ratio of the toner particles having the particle diameter of 4.5 μm or more and less than 7.5 μm, and the circularity of 0.980 or more is preferably in a range of 16% by number to 30% by number, and is further preferably in a range of 16% by number to 25% by number. In addition, from the same aspect, the content ratio of the toner particles having the particle diameter of 7.5 μm or more and less than 15 μm, and the circularity of 0.900 or more and less than 0.940 is preferably 2% by number or less, further preferably 1% by number or less, and still further preferably 0% by number. Note that, the content ratio of the toner particles is the content ratio with respect to the entirety of the toner particles.

By selecting a glass transition temperature, a molecular weight or the like of the binder resin in the toner particles as described later, and controlling time and temperature in the aggregation and coalescence step, the specific toner having the average circularity of 0.955 to 0.971, and satisfying the above-described M ratio and L ratio is provided.

Here, the particle diameter, the circularity, and the average circularity of the toner particle are obtained by using FPIA-3000 manufactured by Sysmex Corporation with respect to the toner particles of the toner to be measured.

The above-mentioned FPIA-3000 manufactured by Sysmex Corporation employs a method of measuring particles dispersed in water or the like according to a flow type image analysis method, and the particle suspension is suctioned and guided to a flat sheath flow cell and is formed to be flattened sample flow by the sheath liquid. When the sample flow is irradiated with strobe light, at least 5000 toner particles passing through the flow are captured as still images through an objective lens by using a CCD camera. The captured particle image is subjected to two-dimensional image processing, and an equivalent circle diameter is calculated from the projected area and the circumferential length. The diameter of a circle having the same area from the area of a two-dimensional image is calculated as the equivalent circle diameter for each imaged particle.

In the exemplary embodiment, the equivalent circle diameter is set to be the particle diameter of the toner particle, and the circularity is calculated by the following Expression (1). Further, it is possible to calculate the content ratio of (% by number) for a certain range of the particle diameter, and the circularity by performing a statistical process of data for each of the toner particles. The same is true for the following description.

Expression (1): circularity=perimeter of equivalent circle diameter/perimeter=$[2\times(A\times\pi)^{1/2}]/PM$ (In the above expression, A represents the projected area and PM represents the circumferential length.)

In addition, from the aspect that the transfer properties of the toner image transferred to the intermediate transfer member from the image holding member are prevented from being deteriorated, in the specific toner, the content ratio of the toner particles having the circularity which is 0.900 or more and less than 0.950 is preferably in a range of 5% by number to 15% by number (further preferably in a range of 10% by number to 15% by number) with respect to the entirety of the toner particles, and the content ratio of the toner particles having the circularity which is in a range of 0.950 to 1.000 is preferably in a range of 75% by number to 85% by number (further preferably in a range of 78% by number to 85% by number) with respect to the entirety of the toner particles.

The volume average particle diameter (D50v) of the toner particles is preferably in a range of 2 μm to 10 μm, and is further preferably in a range of 4 μm to 8 μm.

The volume average particle diameter of the toner particles is measured using COULTER MULTISIZER II (manufactured by Beckman Coulter, Inc.) and ISOTON-II (manufactured by Beckman Coulter, Inc.) as an electrolytic solution. In measurement, 10 mg of a measurement sample is added into 2 ml of a 5 wt % aqueous solution containing sodium dodecylbenzenesulfonate as a dispersant. The measurement sample added to 100 ml of the electrolytic solution is prepared, and the electrolytic solution in which the measurement sample is suspended is dispersed for 1 minute by an ultrasonic disperser. Then, with the COULTER MULTISIZER II, the particle diameter distribution of particles having particle diameter falling within a range of 1.0 μm to 30 μm is measured using an aperture having an aperture diameter of 50 μm to obtain a volume average distribution. The cumulative distributions are drawn from the small particle side with respect to the particle diameter ranges (channels) separated based on measured particle distribution as the volume standard, and the particle diameter (D50v) when the cumulative percentage becomes 50% is defined as the volume average particle diameter of the measurement sample.

Hereinafter, the constituent components of the specific toner will be described.

The specific toner may contain a toner particle containing a binder resin having a crystalline polyester resin, a colorant, and a release agent. The specific toner may contain external additives attached to the surfaces of the toner particles.

Binder Resin

Examples of the binder resin include a crystalline polyester resin. The binder resin may include resins other than the crystalline polyester resin. For example, specific examples of the other resin include vinyl resins formed of homopolymer of monomers such as styrenes (for example, styrene, para-chloro styrene, and α-methyl styrene), (meth) acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (for example, acrylonitrile, and methacrylonitrile), vinyl ethers (for example, vinyl methyl ether, and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

As the binder resin, there are also exemplified non-vinyl resins such as an epoxy resin, an amorphous polyester resin, a polyurethane resin, a polyamide resin, a cellulose resin, a polyether resin, and a modified rosin, a mixture thereof with the above-described vinyl resin, or a graft polymer obtained by polymerizing a vinyl monomer with the coexistence of such non-vinyl resins.

These binder resins other than the crystalline polyester resin may be used singly or in combination of two or more types thereof. Among them, the crystalline polyester resin and the amorphous polyester resin may be suitably used in combination as the binder resin.

In the binder resin, the content of the crystalline polyester resin may be used in a range of 1% by weight to 10% by weight (preferably in a range of 2% by weight to 9% by weight) with respect to the entirety of the binder resin. When the content of the crystalline polyester resin is in the above range, the average circularity of the toner particles is easily controlled to be in a range of 0.955 to 0.971 and the above M ratio and L ratio are easily controlled to be in the above ranges.

Note that, "crystalline" of the resin means having not a stepwise endothermic change but a clear endothermic peak in the differential scanning calorimetry (DSC), and specifically means that the half-value width of the endothermic peak is within 10° C. when measured at a heating rate of 10 (° C./min).

On the other hand, "amorphous" of the resin means that the half value width is higher than 10° C., the endothermic change is stepwise, or a clear endothermic peak is not recognized.

Crystalline Polyester Resin

Examples of the crystalline polyester resin include a polycondensate of polyvalent carboxylic acid and polyol. As the crystalline polyester resin, a commercially available product may be used or, synthesized product may be used.

From the viewpoint that the crystalline polyester resin easily forms a crystalline structure, a polycondensate obtained by using a polymerizable monomer having a linear aliphatic group rather than a polymerizable monomer having an aromatic group is preferable.

Examples of the polyvalent carboxylic acid include aliphatic dicarboxylic acid (for example, oxalic acid, succinic acid, glutaric acid, adipic acid, suberic acid, azelaic acid, sebacic acid, 1,9-nonanedicarboxylic acid, 1,10-decanedicarboxylic acid, 1, 12-dodecanedicarboxylic acid, 1,14-tetradecanedicarboxylic acid, and 1,18-octadecanedicarboxylic acid), aromatic dicarboxylic acid (for example, dibasic acid such as phthalic acid, isophthalic acid, terephthalic acid, naphthalene-2,6-dicarboxylic acid), anhydrides thereof, or lower alkyl esters (having, for example, from 1 to 5 carbon atoms) thereof.

As the polyvalent carboxylic acid, tri- or higher-valent carboxylic acid having a crosslinked structure or a branched structure may be used in combination with dicarboxylic acid. Examples of tri-valent carboxylic acid include aromatic carboxylic acids (for example, 1,2,3-benzenetricarboxylic acid, 1,2,4-benzenetricarboxylic acid, 1,2,4-naphthalenetricarboxylic acid), anhydrides thereof, or lower alkyl esters (having, for example, from 1 to 5 carbon atoms) thereof.

Examples of the polyvalent carboxylic acid include a dicarboxylic acid having a sulfonic acid group and a dicarboxylic acid having an ethylenic double bond may be used together with these dicarboxylic acids.

The polyvalent carboxylic acids may be used singly or in combination of two or more types thereof.

Examples of the polyol include an aliphatic diol (for example, a linear aliphatic diol having a carbon number of 7 to 20 in the main chain portion). Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among them, examples of the aliphatic diol preferably include 1,8-octanediol, 1,9-nonanediol, and 1,10-decanediol.

As the polyol, a tri- or higher-valent polyol having a crosslinked structure or a branched structure may be used in combination with diol. Examples of the tri- or higher-valent polyol include glycerin, trimethylolethane, trimethylolpropane, and pentaerythritol.

The polyol may be used singly or in combination of two or more types thereof.

Here, polyol may have the aliphatic diol of which the content is preferably 80 mol % or more, and further preferably 90 mol % or more.

The melting temperature of the crystalline polyester resin is preferably from 50° C. to 100° C., more preferably from 55° C. to 90° C., and most preferably from 60° C. to 85° C.

The melting temperature is obtained from a DSC curve obtained by differential scanning calorimetry (DSC), and specifically obtained according to "melting peak temperature" described in the method of obtaining a melting temperature in JIS K 7121-1987 "Testing methods for transition temperatures of plastics".

The weight average molecular weight (Mw) of the crystalline polyester resin is preferably in a range of 6,000 to 35,000. The measuring method is the same as that for the weight average molecular weight with respect to the amorphous polyester described later.

In the case where the melting temperature of the crystalline polyester resin is in the above-described range, the average circularity of the toner particles is easy to control to be in a range of 0.955 to 0.971, and the above-described M ratio (the content ratio of toner particles having the particle diameter which is 4.5 μm or more and less than 7.5 μm, and the circularity which is 0.980 or more), and the L ratio (the content ratio of toner particles having the particle diameter which is 7.5 μm or more and less than 15 μm, and the circularity which is 0.900 or more and less than 0.940) are easy to control to be in the above-described range. In addition, in the case where the weight average molecular weight of the crystalline polyester resin is in the above-described range, the average circularity of the toner particles is easy to control to be in a range of 0.955 to 0.971, and the above-described M ratio and L ratio are easy to control to be in the above-described range.

Meanwhile, in a case where the weight average molecular weight of the crystalline polyester resin is excessively large, it is hard to obtain the toner particle which is formed into an almost spherical shape while the average circularity of the toner particles is in a range of 0.955 to 0.971.

The crystalline polyester resin is prepared by using a well-known preparing method, similarly to the preparation of the amorphous polyester resin described later.

Amorphous Polyester Resin

Examples of the amorphous polyester resin include condensation polymers of polyvalent carboxylic acid and polyol. A commercially available product or a synthesized product may be used as the amorphous polyester resin.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acid (for example, cyclohexane dicarboxylic acid), aromatic dicarboxylic acid (for example, terephthalic acid, isophthalic acid, phthalic acid, and naphthalene dicarboxylic acid), an anhydride thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, tri- or higher-valent carboxylic acid having a crosslinked structure or a branched structure may be used in combination with dicarboxylic acid. Examples of the tri- or higher-valent carboxylic acid include trimellitic acid, pyromellitic acid, anhydrides thereof, or lower alkyl esters (having, for example, 1 to 5 carbon atoms) thereof.

The polyvalent carboxylic acids may be used singly or in combination of two or more types thereof.

Examples of the polyol include aliphatic diol (for example, ethylene glycol, diethylene glycol, triethylene glycol, propylene glycol, butanediol, hexanediol, and neopentyl glycol), alicyclic diol (for example, cyclohexanediol, cyclohexane dimethanol, and hydrogenated bisphenol A), aromatic diol (for example, an ethylene oxide adduct of bisphenol A, and a propylene oxide adduct of bisphenol A). Among these, for example, aromatic diols and alicyclic diols are preferably used, and aromatic diols are more preferably used as the polyol.

As the polyol, a tri- or higher-valent polyol having a crosslinked structure or a branched structure may be used in combination with diol. Examples of the tri- or higher-valent polyol include glycerin, trimethylolpropane, and pentaerythritol.

The polyol may be used singly or in combination of two or more types thereof.

The glass transition temperature (Tg) of the amorphous polyester resin is preferably from 50° C. to 80° C., and more preferably from 50° C. to 65° C.

The glass transition temperature is obtained from a DSC curve obtained by differential scanning calorimetry (DSC). More specifically, the glass transition temperature is obtained from "Extrapolated glass transition onset temperature" described in the method of obtaining a glass transition temperature in JIS K 7121-1987 "Testing methods for transition temperatures of plastics".

The weight average molecular weight (Mw) of the amorphous polyester resin is preferably from 5,000 to 1,000,000, and more preferably from 7,000 to 500,000.

The number average molecular weight (Mn) of the amorphous polyester resin is preferably from 2,000 to 100,000.

The molecular weight distribution Mw/Mn of the amorphous polyester resin is preferably from 1.5 to 100, and more preferably from 2 to 60.

The weight average molecular weight and the number average molecular weight are measured by gel permeation chromatography (GPC). The molecular weight measurement by GPC is performed using GPC: HLC-8120 GPC, manufactured by Tosoh Corporation as a measuring device, column: TSK gel SUPER HM-M (15 cm), manufactured by Tosoh Corporation, and a THF solvent. The weight average molecular weight and the number average molecular weight are calculated by using a molecular weight calibration curve plotted from a monodisperse polystyrene standard sample from the results of the foregoing measurement.

In addition, in the case where the glass transition temperature of the amorphous polyester resin is in the above-described range, the average circularity of the toner particles is easy to control to be in a range of 0.955 to 0.971, and the above M ratio and L ratio are easy to control to be in the above range. In addition, in the case where the weight average molecular weight of the amorphous polyester resin is in the above-described range, the average circularity of the toner particles is easy to control to be in a range of 0.955 to 0.971, and the above M ratio and L ratio are easy to control to be in the above range. Further, for example, in the case where the weight average molecular weight of the amorphous polyester resin is excessively large, it is hard to obtain the toner particle which is formed into an almost spherical shape while the average circularity of the toner particles is in a range of 0.955 to 0.971.

A known preparing method is used to prepare the amorphous polyester resin. Specific examples thereof include a method of conducting a reaction at a polymerization temperature set to be in a range of 180° C. to 230° C., if necessary, under reduced pressure in the reaction system, while removing water or an alcohol generated during condensation.

When monomers of the raw materials are not dissolved or compatibilized at a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

The content of the binder resin is preferably from 40% by weight to 95% by weight, more preferably from 50% by weight to 90% by weight, and most preferably from 60% by weight to 85% by weight, with respect to the entirety of the toner particles.

Colorant

Examples of the colorant includes various types of pigments such as carbon black, chrome yellow, Hansa yellow, benzidine yellow, threne yellow, quinoline yellow, pigment yellow, Permanent Orange GTR, Pyrazolone Orange, Vulcan Orange, Watch Young Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate, or various types of dyes such as acridine dye, xanthene dye, azo dye, benzoquinone dye, azine dye, anthraquinone dye, thioindigo dye, dioxazine dye, thiazine dye, azomethine dye, indigo dye, phthalocyanine dye, aniline black dye, polymethine dye, triphenylmethane dye, diphenylmethane dye, and thiazole dye.

The colorants may be used singly or in combination of two or more types thereof.

As the colorant, if necessary, a surface-treated colorant may be used, or a dispersant may be used in combination. Further, as the colorant, plural types of colorants may be used in combination.

The content of the colorant is preferably in a range of 1% by weight to 30% by weight, and is further preferably in a range of 3% by weight to 15% by weight with respect to the entirety of the toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. However, the release agent is not limited to the above examples.

The melting temperature of the release agent is preferably from 50° C. to 110° C., and more preferably from 60° C. to 100° C.

The melting temperature is obtained from a DSC curve obtained by differential scanning calorimetry (DSC), and specifically obtained from "melting peak temperature" described in the method of obtaining a melting temperature in JIS K 7121-1987 "Testing methods for transition temperatures of plastics".

The content of the release agent is preferably from 1% by weight to 20% by weight, and more preferably from 5% by weight to 15% by weight with respect to the entirety of the toner particles.

Other Additives

Examples of other additives include well-known additives such as a magnetic material, a charge controlling agent, and an inorganic powder. These additives are contained in the toner particle as internal additives.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

Surfaces of the inorganic particles as an external additive are preferably subjected to a hydrophobizing treatment with a hydrophobizing agent. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of the external additive include a resin particle (resin particle such as polystyrene, polymethyl methacrylate (PMMA), and melamine resin), a cleaning active agent (for example, metal salts of higher fatty acids typified by zinc stearate, and particles having fluorine high molecular weight polymer).

In the case where the specific toner contains the toner particles and the external additive, when an image having a low image density (for example, 5% or less) is formed under the high temperature and high humidity environment (for example, temperature of 28° C. and humidity 85% RH), particularly, even when the images are continuously formed on both sides of the recording medium under the high temperature and high humidity environment, the transfer properties of the toner image with respect to the intermediate transfer member are prevented from being deteriorated. This is presumed as follows.

First, the toner particles are easy to be softened under the high temperature and high humidity environment. Further, when the toner image is formed by the image forming apparatus including the above-described guide unit, in the guide unit, the image holding member and the intermediate transfer member contact with each other, with the toner image being interposed therebetween, and the contact time between the image holding member and the intermediate transfer member via the toner image is long as compared with the image forming apparatus not having the guide unit. Therefore, a load (stress) with respect to the toner image becomes larger. In addition, with the image having the low image density, the number of the toner images formed on the image holding member is a small, and thus the load applied to the toner image becomes larger in the guide unit. On the other hand, in a case where the toner particles may have irregularities, the external additives tend to be distributed and to be unevenly distributed in recessed portions of the toner particles, and thus the surface of the toner particle is likely to be exposed, and the toner image is easily attached to the image holding member.

Therefore, in the image forming apparatus including the above guide unit, when the image having the low image density is formed under the high temperature and high humidity environment, the toner image containing the toner particles which are softened under the high temperature and high humidity environment are loaded for a long time, and thus the toner image containing the exposed toner particles is easily attached to the image holding member. Particularly, in the case where images are continuously formed on both sides of the recording medium, the temperature of the intermediate transfer member tends to be increased due to the heat added to the recording medium by the fixing unit, and thus the above phenomenon tends to be remarkable.

On the other hand, in the specific toner having the average circularity within the above range, the content ratio of the toner particles having coarse particle diameter and low circularity is small, and the content ratio of the toner particles having a small diameter and an almost spherical shape is large. The specific toner has small amount of the toner particles having large particle diameter with many irregularities, and thus the external additives tend to be prevented from being unevenly distributed in the irregularities of the toner particles. In addition, in the specific toner, the external additives are not likely to be unevenly distributed in the toner particles, and thus the toner particles are not easily exposed. For this reason, in the image forming apparatus including the above-described guide unit, in the case where the image having the low density is formed on the recording medium by using the specific toner under the high temperature and high humidity environment, particularly, even in the case where the images are continuously formed on the both sides of the recording medium, in the specific toner, the surface of the toner particles are not easily exposed due to the uneven distribution of the external additives, and thus are not easily attached to the image holding member. In addition, as described above, the non-electrostatic adhesion with respect to the surface of the photoreceptor is weakened depending on the shape of the specific toner. As a result, it is presumed that, in the case where the specific toner contains the toner particles and the external additive, the toner particles are prevented from being exposed and thus prevented from being attached to the image holding member, the non-electrostatic adhesion is prevented, and therefore, the transfer properties of the toner image transferred to the intermediate transfer member from the image holding member are prevented from being deteriorated.

The amount of the external additive is, for example, preferably in a range of 0.01% by weight to 5% by weight, and is further preferably in a range of 0.01% by weight to 2.0% by weight with respect to the toner particles.

Preparing Method of Specific Toner

Next, the method of preparing the specific toner will be described.

The specific toner is obtained by additionally adding the external additive to the toner particles after preparing the toner particles.

The preparing method of the toner particles is not particularly limited, and well-known method may be employed. For example, the toner particles may be prepared by using a wetting method (for example, an aggregation and coalescence method, a suspension polymerization method, and a dissolution suspension method).

Among them, the toner particles may be obtained by using the aggregation and coalescence method.

Specifically, for example, in a case where the toner particles are prepared by using the aggregation and coalescence method, the toner particles are prepared through the steps. The steps include a step (a resin particle dispersion preparing step) of preparing a resin particle dispersion in which resin particles constituting the binder resin containing the crystalline polyester resin are dispersed, a colorant particle dispersion in which particles of the colorant (hereinafter, also referred to as "a colorant particle") are dispersed, and a release agent particle dispersion in which particles of the release agent (hereinafter, also referred to as "a release agent particle") are dispersed; a step (an aggregated particles forming step) of forming aggregated particles by aggregating the resin particle, the colorant particle, and the release agent particle in the resin particle dispersion; and a step (a coalescence step) of coalescing aggregated particles by heating an aggregated particle dispersion in which aggregated particles are dispersed so as to form toner particles.

Hereinafter, the respective steps will be described in detail.

In the following description, a method of obtaining toner particles including the colorant and the release agent will be described; however, other additives other than the colorant and the release agent may also be used.

Resin Particle Dispersion Preparing Step

First, along with a resin particle dispersion in which the resin particles, which are to form the binder resin containing the crystalline polyester resin, are dispersed, for example, a colorant particle dispersion in which colorant particles are dispersed and a release agent particle dispersion in which the release agent particles are dispersed are prepared.

As the binder resin, in a case where the crystalline polyester resin and amorphous polyester are used in combination, a resin particle dispersion in which the crystalline polyester resin and the amorphous polyester are mixed with each other may be prepared as the resin particle dispersion.

Here, the resin particle dispersion is, for example, prepared by dispersing the resin particles in a dispersion medium with a surfactant.

An aqueous medium is used, for example, as the dispersion medium used in the resin particle dispersion.

Examples of the aqueous medium include water such as distilled water, ion exchanged water, or the like, alcohols, and the like. The medium may be used singly or in combination of two or more types thereof.

Examples of the surfactant include an anionic surfactant such as sulfate, sulfonate, phosphate, and soaps; a cationic surfactant such as amine salt and quaternary ammonium salt; and a nonionic surfactant such as polyethylene glycol, alkyl phenol ethylene oxide adduct, and polyol. Among them, the anionic surfactant and the cationic surfactant are particularly preferable. The nonionic surfactant may be used in combination with the anionic surfactant or the cationic surfactant.

The surfactants may be used singly or in combination of two or more types thereof.

Regarding the resin particle dispersion, as a method of dispersing the resin particles in the dispersion medium, a general dispersing method using, for example, a rotary shearing-type homogenizer, or a ball mill, a sand mill, or a DYNO mill is exemplified. Depending on the type of the resin particles, the resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding a base to the organic continuous phase (O phase); and adding an aqueous medium (W phase) to thereby form a discontinuous phase and convert the resin (so-called phase inversion) from W/O to O/W, thus dispersing the resin as particles in the aqueous medium.

The volume average particle diameter of the resin particles dispersed in the resin particle dispersion is, for example, preferably from 0.01 μm to 1 μm, more preferably from 0.08 μm to 0.8 μm, and most preferably from 0.1 μm to 0.6 μm.

Regarding the volume average particle diameter of the resin particles, a cumulative distribution by volume is drawn from the side of the smallest diameter with respect to particle diameter ranges (channels) separated using the particle diameter distribution obtained by the measurement of a laser diffraction-type particle diameter distribution measuring device (for example, manufactured by Horiba, Ltd., LA-700), and a particle diameter when the cumulative percentage becomes 50% with respect to the entire particles is measured as a volume average particle diameter D50v. The volume average particle diameter of the particles in other dispersions is also measured in the same manner.

The content of the resin particles contained in the resin particle dispersion is, for example, preferably in a range of 5% by weight to 50% by weight, and further preferably in a range of 10% by weight to 40% by weight.

The colorant particle dispersion and the release agent particle dispersion are also prepared in the same manner as in the case of the resin particle dispersion. That is, the volume average particle diameter, the dispersion medium, the dispersing method, and the content of the particles with respect to the resin particles in the resin particle dispersion described above may be applied to those of the colorant particles dispersed in the colorant particle dispersion and the release agent particle dispersed in the release agent particle dispersion.

Aggregated Particles Forming Step

Next, the resin particle dispersion, the colorant particle dispersion, and the release agent particle dispersion are mixed with each other.

The resin particles, the colorant particles, and the release agent particle are heterogeneously aggregated in the mixed dispersion, thereby forming aggregated particles having a diameter near a target toner particle diameter and including the resin particles, the colorant particles, and the release agent particles.

Specifically, for example, an aggregating agent is added to the mixed dispersion and a pH of the mixed dispersion is adjusted to be acidic (for example, the pH is from 2 to 5). If necessary, a dispersion stabilizer is added thereto. Then, the mixed dispersion is heated at a temperature of a glass transition temperature of the resin particles (specifically, for example, in a range of from a temperature 30° C. lower than the glass transition temperature to a temperature 10° C. lower than the glass transition temperature with respect to the resin particles) to aggregate the particles dispersed in the mixed dispersion, thereby forming the aggregated particles.

In the aggregated particle forming step, for example, the aggregating agent may be added at room temperature (for example, 25° C.) while stirring the mixed dispersion with a rotary shearing-type homogenizer, the pH of the mixed dispersion may be adjusted to be acidic (for example, the pH is from 2 to 5), a dispersion stabilizer may be added if necessary, and then the heating may be performed.

Examples of the aggregating agent include a surfactant, an inorganic metal salt, or a divalent or more metal complex, which has an opposite polarity to the polarity of the surfactant used as the dispersing agent to be added to the mixed dispersion. Particularly, when a metal complex is used as the aggregating agent, the amount of the surfactant to be used is reduced and charging characteristics are improved.

An additive for forming a complex or a similar bond with a metal ion contained in the aggregating agent may be used, if necessary. A chelating agent is suitably used as the additive.

Examples of the inorganic metal salt include metal salt such as calcium chloride, calcium nitrate, barium chloride, magnesium chloride, zinc chloride, aluminum chloride, and aluminum sulfate, and an inorganic metal salt polymer such as poly aluminum chloride, poly aluminum hydroxide, and calcium polysulfide.

As the chelating agent, an aqueous chelating agent may be used. Examples of the chelating agent include oxycarboxylic acid such as tartaric acid, citric acid, and gluconic acid, iminodiacetic acid (IDA), nitrilotriacetic acid (NTA), and ethylenediaminetetraacetic acid (EDTA).

The additive amount of the chelating agent is, for example, preferably in a range of 0.01 parts by weight to 5.0 parts by weight, and is further preferably 0.1 parts by weight or more and less than 3.0 parts by weight, with respect to 100 parts by weight of the resin particles.

Coalescence Step

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to coalesce the aggregated particles and form toner particles.

Here, by adjusting a product (total heat quantity) of temperature and time with respect to the aggregated particle dispersion in the coalescence step, the average circularity of the toner particles may be controlled to be in a range of 0.955 to 0.971, and the above-described M ratio (the content ratio of the toner particles having the particle diameter of 4.5 μm or more and less than 7.5 μm, and the circularity of 0.980 or more) and the L ratio (the content ratio of the toner particles having the particle diameter of 7.5 μm or more and less than 15 μm, and the circularity of 0.900 or more and less than 0.940) may be controlled. As the heating is performed at a high temperature for long period of time, the toner particles are likely to be formed in to a spherical shape, and when a product of temperature and time is excessively large, the average circularity of the toner particles is particularly hard to satisfy the above-described range. For this reason, a product of temperature and time with respect to the aggregated particle dispersion is adjusted such that the average circularity of the toner particles satisfies the range of 0.955 to 0.971, and thereby the above-described M ratio and L ratio may be controlled.

The toner particles are obtained through the foregoing steps.

The toner particles may be obtained through a step of forming a second aggregated particles in such a manner that an aggregated particle dispersion in which the aggregated particles are dispersed is obtained, the aggregated particle dispersion and a resin particle dispersion in which resin particles are dispersed are mixed, and the mixtures are aggregated so that the resin particles are attached on the surface of the aggregated particle, and a step of forming the toner particles having a core/shell structure by heating a second aggregated particle dispersion in which the second aggregated particles are dispersed, thereby coalescing the second aggregated particles.

Here, after the coalescence step ends, the toner particles formed in the solution are subjected to a washing step, a solid-liquid separation step, and a drying step, that are well known, thereby obtaining dry toner particles.

In the washing step, displacement washing using ion exchanged water may be sufficiently performed from the viewpoint of charging properties. In addition, the solid-liquid separation step is not particularly limited, but suction filtration, pressure filtration, or the like is preferably performed from the viewpoint of productivity. The method of the drying step is also not particularly limited, but freeze drying, airflow drying, fluidized drying, vibration-type fluidized drying, or the like may be performed from the viewpoint of productivity.

The specific toner according to the exemplary embodiment is prepared by adding and mixing, for example, an external additive to the obtained dry toner particles, if necessary. The mixing may be performed with, for example, a V-blender, a HENSCHEL mixer, a LÖDIGE MIXER, or the like. Furthermore, if necessary, coarse particles of the toner may be removed by using a vibration classifier, a wind classifier, or the like.

Developer

The developer contains the above-described specific toner.

The developer may be a single-component developer containing only the specific toner, or a two-component developer obtained by mixing the specific toner with a carrier.

The carrier is not particularly limited, and a well-known carrier may be used. Examples of the carrier include a coating carrier in which the surface of the core formed of magnetic particles is coated with the coating resin; a magnetic particle dispersion-type carrier in which the magnetic particles are dispersed in the matrix resin; and a resin impregnated-type carrier in which a resin is impregnated into the porous magnetic particles.

The magnetic particle dispersion-type carrier and the resin impregnated-type carrier may be a carrier in which the particles which form the above carrier are set as a core and the core is coated with the coating resin.

Examples of the magnetic particle include a magnetic metal such as iron, nickel, and cobalt, and a magnetic oxide such as ferrite, and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, and a straight silicone resin formed by containing an organosiloxane bond or the modified products thereof, a fluorine resin, polyester, polycarbonate, a phenol resin, and an epoxy resin.

Other additives such as the conductive particles may be contained in the coating resin and the matrix resin.

Examples of the conductive particles include particles of metal such as gold, silver, and copper, carbon black, titanium oxide, zinc oxide, tin oxide, barium sulfate, aluminum borate, and potassium titanate.

Here, in order to coat the surface of the core with the coating resin, a method of coating the surface with a coating layer forming solution in which the coating resin, and various additives if necessary are dissolved in a proper solvent is exemplified. The solvent is not particularly limited as long as a solvent is selected in consideration of a coating resin to be used and coating suitability.

Specific examples of the resin coating method include a dipping method of dipping the core into the coating layer forming solution, a spray method of spraying the coating layer forming solution onto the surface of the core, a fluid-bed method of spraying the coating layer forming solution to the core in a state of being floated by the fluid air, and a kneader coating method of mixing the core of the carrier with the coating layer forming solution in the kneader coater and removing a solvent.

The mixing ratio (weight ratio) of the specific toner to the carrier in the two-component developer is preferably in a range of specific toner: carrier=1:100 to 30:100, and is further preferably in a range of 3:100 to 20:100.

As described above, an example of the image forming apparatus according to the exemplary embodiment is described with reference to the drawings; however, the exemplary embodiment is not limited thereto.

EXAMPLES

Hereinafter, the exemplary embodiment will be more specifically described with reference to Examples and Comparative Examples; however, the exemplary embodiment is not limited thereto. Note that, "part" means "part by weight" unless otherwise noted.

Preparation of Toner

Preparation of Crystalline Polyester Resin (A)

First, 100 parts by weight of dimethyl sebacate, 67.8 parts by weight of hexane diol, and 0.10 parts by weight of dibutyl tin oxide are allowed to react with each other under nitrogen atmosphere at 185° C. for five hours in a three-necked flask while removing water generated during the reaction to the outside, then the temperature is increased to 220° C. while slowly reducing pressure, and the reaction is performed for six hours, followed by cooling. Thus, a crystalline polyester resin (A) having the weight average molecular weight of 33,700 is prepared.

Preparation of Amorphous Polyester Resin (1)

First, 60 parts by weight of dimethyl terephthalate, 82 parts by weight of dimethyl fumarate, 34 parts by weight of dodecenyl succinic anhydride, 137 parts by weight of bisphenol A ethylene oxide adduct, 191 parts by weight of bisphenol A propylene oxide adduct, and 0.5 parts by weight of dibutyl tin oxide are allowed to react with each other under nitrogen atmosphere at 180° C. for three hours in a three-necked flask while removing water generated during the reaction to the outside, the temperature is increased up to 230° C. while slowly reducing pressure, and the reaction is performed for three hours, followed by cooling. Thus, an amorphous polyester resin (1) having the weight average molecular weight of 22100 is prepared.

Preparation of Colorant Particle Dispersion

Further, a colorant particle dispersion is prepared by mixing 50 parts by weight of cyan pigment (copper phthalocyanine, C.I. Pigment blue 15:3, prepared by Dainichiseika Color & Chemicals Mfg. Co., Ltd.), 5 parts by weight of nonionic surfactant NONIPOL 400 (prepared by Kao Corporation), and 200 parts by weight of ion exchanged water, dispersing the mixture for about one hour by using a high-pressure impact disperser ULTIMAIZER (HJP30006, manufactured by Sugino Machine Ltd.), and adjusting the moisture amount.

Preparation of Release Agent Particle Dispersion

A release agent particle dispersion having a moisture amount adjusted such that the concentration of the release agent becomes 20% by weight in the dispersion in which the release agent having the volume average particle diameter of 250 nm is dispersed is prepared by heating a solution at 120° C., the solution being prepared by mixing 60 parts by weight of paraffin wax (HNP9, manufactured by Nippon Seiro, Co., Ltd., melting point of 77° C.), 4 parts by weight of anionic surfactant (NEOGEN RK, manufactured by Dai-Ichi Kogyo Seiyaku Co., Ltd.), and 200 parts by weight of ion exchanged water, subjecting the solution to a dispersing treatment with a homogenizer (ULTRA-TURRAX T50, manufactured by IKA Ltd.), and then a dispersing treatment with MANTON-GAULIN high pressure homogenizer (manufactured by Manton Gaulin Mfg Company Inc) under the condition of 120° C., 350 kg/cm$^2$, and one hour.

Preparation of Rosin Dispersion 100 parts by weight of rosin (prepared by Harima Chemicals Group, Inc.) and 78 parts by weight of methyl ethyl ketone are put into the three-necked flask, the resin is dissolved in the three-necked flask while being stirred, 350 parts by weight of ion exchanged water is added into the three-necked flask, and the three-necked flask is warmed up. Then, the resultant is dispersed by using a homogenizer (ULTRA-TURRAX T50, manufactured by IKA Ltd.), and removing the solvent is performed. The volume average particle diameter is 185 nm. To the resultant, ion exchanged water is added, thereby preparing a rosin dispersion having the solid concentration of 25%.

Preparation of Crystalline/Amorphous Mixed Polyester Resin Particle Dispersion (A1)

A crystalline/amorphous mixed polyester resin particle dispersion (A1) in which crystalline/amorphous mixed polyester resin particles having the volume average particle diameter of 158 nm are dispersed, and which has a solid concentration of 25% is prepared by putting 5 parts by weight of crystalline polyester resin (A), 95 parts by weight of amorphous polyester resin (1), 50 parts by weight of methyl ethyl ketone, and 15 parts by weight of isopropyl alcohol into the three-necked flask, dissolving the resin by heating at 60° C. with stirring, then adding 25 parts by weight of 10% ammonia aqueous solution into the three-necked flask, slowly adding further 400 parts by weight of ion exchanged water into the three-necked flask to thereby perform a phase inversion emulsification, then reducing the pressure, and performing removing solvent.

Preparation of Amorphous Resin Particle Dispersion (A2)

An amorphous polyester resin particle dispersion (A2) in which amorphous polyester resin particles having the volume average particle diameter of 175 nm are dispersed and which has a solid concentration of 25% is prepared by using the same method as that of the crystalline/amorphous mixed polyester resin particle dispersion (A1) except that the amount of the amorphous polyester resin (1) is changed to 100 parts by weight.

Preparation of Toner Particle 1

720 parts by weight of crystalline/amorphous mixed polyester resin particle dispersion (A1), 50 parts by weight of the colorant particle dispersion, 70 parts by weight of the release agent particle dispersion, 6 parts by weight of rosin dispersion, 2.2 parts by weight of water glass (SNOWTEX OL (registered trademark) manufactured by Nissan Chemical Industries), and 1.5 parts by weight of cationic surfactant (SANISOL B50, prepared by Kao Corporation) are put into to a round stainless steel flask, 0.1 N sulfuric acid is added thereto to adjust pH to 3.8, 30 parts by weight of nitric acid aqueous solution having 10% by weight of concentration of polyaluminum chloride as coagulant is added into the flask, and then, the mixture is dispersed at 30° C. by using a homogenizer (ULTRA-TURRAX T50, manufactured by IKA Ltd.). The resultant is heated up to 40° C. at 1° C./min in oil bath for heating, held at 40° C. for 30 minutes, and then 160 parts by weight of amorphous polyester resin particle dispersion (A2) is slowly added into the dispersion, and further held for one hour.

After that, after adjusting pH to 7.0 by adding 0.1 N sodium hydroxide, the resultant is heated up to 88° C. at 1° C./min while continuously stirring, held for four hours, cooled up to 20° C. at a rate of 20° C./min, filtrated, washed with ion exchanged water, and then dried by using a vacuum dryer so as to obtain a toner particle 1. The content of the crystalline polyester resin in the toner particle 1 is 4.1 parts by weight with respect to the binder resin in the toner.

In the toner particle 1, the content ratio of toner particles having the volume average particle diameter of 5.5 μm, the average circularity of 0.963, the particle diameter of 4.5 μm or more and less than 7.5 μm, and the circularity of 0.980 or more is 25%, and the content ratio of the toner particles having the particle diameter of 7.5 μm or more and less than 15 μm, and the circularity of 0.900 or more and less than 0.940 is 1.1%.

Further, the ratio of the circularity of the toner particle 1 with respect to the entirety of the toner particles is 0.900 or more and less than 0.950, and the ratio of the circularity with respect to the entirety of the toner particles is in a range of 0.950 to 1.000 are also measured. The results are indicated in Table 1.

The volume average particle diameter of the total toner particles of toner as indicated in Table 1 is measured by using the above-described measuring method.

In addition, all of the toners indicated in Table 1 are obtained by adding 1.2 parts by weight of commercially available fumed silica RX 50 (manufactured by Nippon Aerosil Co., Ltd.) as an external additive to 100 parts by weight of toner particles by using a HENSCHEL mixer (MITSUI MIKE MACHINERY Co. Ltd.) under the conditions of peripheral speed 30 m/s and 5 minutes.

Further, a two-component developer is prepared by mixing 8 parts by weight of the toner to which the external additive is added, and 100 parts by weight of the carrier. The carrier is prepared in the following manner. 100 parts by weight of ferrite particles (the volume average particle diameter: 50 μm), 14 parts by weight of toluene, and 2 parts by weight of styrene-methyl methacrylate copolymer (component ratio: styrene/methyl methacrylate=90/10, the weight average molecular weight Mw=80,000) are prepared, then these components except for ferrite particles are dispersed with stirring for 10 minutes with a stirrer so as to prepare a coating solution. Then, the coating solution and the ferrite particles are put into a vacuum degassing type kneader (manufactured by Inoue Seisakusho Co., Ltd), the mixture is stirred at 60° C. for 30 minutes, the pressure is reduced to further degas while warming up the mixture, so that the mixture is dried, and then classifying with a mesh of 105 μm is performed.

Preparation of Toner Particle 2

A toner particle 2 is prepared in the same manner as in preparing the toner particle 1 except that the content of the rosin dispersion is changed from 6 parts by weight to 4.8 parts by weight, the content of water glass is changed from 2.2 parts by weight to 3.4 parts by weight, and the heating temperature and time is changed from 88° C. and four hours to 85° C. and three hours. The crystalline polyester resin in the toner particle 2 is 4.1 parts by weight with respect to the binder resin in the toner particles.

In the toner particle 2, the content ratio of the toner particles having the volume average particle diameter of 5.8 μm, the average circularity of 0.956, the particle diameter of 4.5 μm or more and less than 7.5 μm, and the circularity of 0.980 or more is 17%, and the content ratio of the toner particles having the particle diameter of 7.5 μm or more and less than 15 μm, and the circularity of 0.900 or more and less than 0.940 is 2.8%.

In addition, the ratio of the toner particles having the circularity which is 0.900 or more and less than 0.950 with respect to the entirety of the toner particles of the toner particle 2, and the ratio of the toner particles having the circularity which is in a range of 0.950 to 1.000 with respect to the entirety of the toner particles are also measured. The results are indicated in Table 1.

Preparation of Toner Particles 3

A toner particle 3 is prepared in the same manner as in preparing the toner particle 1 except that the content of the rosin dispersion is changed from 6 parts by weight to 4.8 parts by weight, the content of water glass is changed from 2.2 parts by weight to 5.8 parts by weight, and the heating temperature and time is changed from 88° C. and four hours to 85° C. and three hours. The crystalline polyester resin in the toner particle 3 is 4.1 parts by weight with respect to the binder resin in the toner particles.

In the toner particle 3, the content ratio of the toner particles having the volume average particle diameter of 5.8 μm, the average circularity of 0.951, the particle diameter of 4.5 μm or more and less than 7.5 μm, and the circularity of 0.980 or more is 12%, and the content ratio of the toner particles having the particle diameter of 7.5 μm or more and less than 15 μm, and the circularity of 0.900 or more and less than 0.940 is 3.2%.

In addition, the ratio of the toner particles having the circularity which is 0.900 or more and less than 0.950 with respect to the entirety of the toner particles of the toner particle 3, and the ratio of the toner particles having the circularity which is in a range of 0.950 to 1.000 with respect to the entirety of the toner particles are also measured. The results are indicated in Table 1.

Preparation of Toner Particles 4

A toner particle 4 is prepared in the same manner as in preparing the toner particle 1 except that the content of the rosin dispersion is changed from 6 parts by weight to 7.8 parts by weight, the content of water glass is changed from 2.2 parts by weight to 1.4 parts by weight, and the heating temperature and time is changed from 88° C. and four hours to 90° C. and four hours. The crystalline polyester resin in the toner particle 4 is 4.1 parts by weight with respect to the binder resin in the toner particles.

In the toner particle 4, the content ratio of the toner particles having the volume average particle diameter of 5.7 μm, the average circularity of 0.970, the particle diameter of 4.5 μm or more and less than 7.5 μm, and the circularity of 0.980 or more is 38%, and the content ratio of the toner particles having the particle diameter of 7.5 μm or more and less than 15 μm, and the circularity of 0.900 or more and less than 0.940 is 0.4%.

In addition, the ratio of the toner particles having the circularity which is 0.900 or more and less than 0.950 with respect to the entirety of the toner particles of the toner particle 4, and the ratio of the toner particles having the circularity which is in a range of 0.950 to 1.000 with respect to the entirety of the toner particles are also measured. The results are indicated in Table 1.

Preparation of Toner Particles 5

A toner particle 5 is prepared in the same manner as in preparing the toner particle 1 except that the content of the rosin dispersion is changed from 6 parts by weight to 7.8 parts by weight, the content of water glass is changed from 2.2 parts by weight to 1.6 parts by weight, and the heating temperature and time is changed from 88° C. and four hours to 90° C. and five hours. The crystalline polyester resin in the toner particle 5 is 4.1 parts by weight with respect to the binder resin in the toner particles.

In the toner particle 5, the content ratio of the toner particles having the volume average particle diameter of 5.9 μm, the average circularity of 0.973, the particle diameter of 4.5 μm or more and less than 7.5 μm, and the circularity of 0.980 or more or more is 43%, and the content ratio of the toner particles having the particle diameter of 7.5 μm or more and less than 15 μm, and the circularity of 0.900 or more and less than 0.940 is 0.2%.

In addition, the ratio of the toner particles having the circularity which is 0.900 or more and less than 0.950 with respect to the entirety of the toner particles of the toner particle 5, and the ratio of the toner particles having the circularity which is in a range of 0.950 to 1.000 with respect to the entirety of the toner particles are also measured. The results are indicated in Table 1.

Evaluation

A modifier which contains the above-described developer in the developing device, and is modified by providing D136 Printer manufactured by Fuji Xerox Co., Ltd with a guide roller that guides the intermediate transfer belt and the photoreceptor by deforming the intermediate transfer belt such that the intermediate transfer belt and the photoreceptor are disposed along with each other is prepared.

Here, the rotational speed of the surface of the photoreceptor at the time of forming images is set to be 600 mm/s, and a fixing temperature by the fixing unit is set to be 175° C.

Further, a distance in which a portion of the surface of the image holding member and a portion of the surface of the intermediate transfer member are disposed along with each other by the guide roller is 10 mm.

Evaluation of Transfer Properties (Image Quality Evaluation)

The toner applied amount on the photoreceptor is fixed to be 4.5 g/m$^2$, the image is formed on 100 pieces of solid patches having a size of 3 cm×3 cm, and then the image density is measured by using X-RITE 404 (manufactured by X-Rite, Inc.). Regarding the 100 pieces solid patches on which the image is formed, the measurement is performed three times for each piece, and then the average value is calculated so as to set a density value. The results are indicated in Table 1.

Evaluation Criteria

A: Density value is 1.55 or more

B: Density value is 1.50 or more and less than 1.55

C: Density value is less than 1.50

Evaluation of Transfer Properties (Visual Evaluation)

The density unevenness is confirmed for the above-mentioned solid patch. The results are indicated in Table 1.

Evaluation Criteria

A: There is no density unevenness

B: Density unevenness is slightly found, but there is no problem in actual use

C: There is density unevenness

Regarding the evaluations, A and B indicate that there is no problem in actual use, and C indicates that there is a problem.

TABLE 1

| | Toner | | | | | | Evaluation (transfer properties) | |
|---|---|---|---|---|---|---|---|---|
| | No. | Average R | M ratio (% by number) | L ratio (% by number) | 0.900 ≤ R < 0.950 % by number) | 0.950 ≤ R ≤ 1.000 (% by number) | Image quality evaluation | Visual evaluation |
| Example 1 | 1 | 0.963 | 25 | 1.1 | 11 | 77 | A | A |
| Example 2 | 2 | 0.956 | 17 | 2.8 | 14 | 72 | B | A |
| Example 3 | 4 | 0.970 | 38 | 0.4 | 7 | 82 | A | B |
| Comparative Example 1 | 3 | 0.951 | 12 | 3.2 | 17 | 69 | C | C |
| Comparative Example 2 | 5 | 0.973 | 43 | 0.2 | 4 | 91 | C | C |

In Table 1, "M ratio" represents the content ratio of particles having a particle diameter in a range of 4.5 μm or more and less than 7.5 μm and a circularity of 0.980 or more, "L ratio" represents the content ratio of particles having a particle diameter in a range of 7.5 μm or more and less than 15 μm and a circularity in a range of 0.900 or more and less than 0.940, and R represents the circularity.

From the above-described results, it is found that the transfer properties of the toner image are prevented from being deteriorated in Examples as compared with Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member;

a charge unit that charges a surface of the image holding member;

an electrostatic latent image forming unit that forms an electrostatic latent image on a charged surface of the image holding member;

a developing unit that contains a developer containing toner particles, and develops the electrostatic latent image formed on the surface of the image holding member with the developer to form a toner image;

an intermediate transfer member of which the toner image is to be transferred to a surface;

a primary transfer unit that primarily transfers the toner image formed on the surface of the image holding member to the surface of the intermediate transfer member;

a second transfer unit that secondarily transfers the toner image transferred on the surface of the intermediate transfer member to a surface of a recording medium; and a guide unit that is provided on an upstream in the rotation direction of the intermediate transfer member from the primary transfer unit, and guides at least one of the image holding member and the intermediate transfer member to a primary transfer position provided by the primary transfer unit such that a portion of the surface of the image holding member and a portion of the surface of the intermediate transfer member are disposed along with each other, wherein the toner particles contain a binder resin containing a crystalline polyester resin, a colorant and a release agent, and have an average circularity in a range of 0.955 to 0.971, a content ratio of the toner particles having a particle diameter of 4.5 μm or more and less than 7.5 μm and a circularity of 0.980 or more is in a range of 16% by number to 40% by number, and a content ratio of the toner particles having a particle diameter of 7.5 μm or more and less than 15 μm and a circularity of 0.900 or more and less than 0.940 is 3% by number or less.

2. The image forming apparatus according to claim 1, wherein the content ratio of toner particles having a particle diameter of 4.5 μm or more and less than 7.5 μm and a circularity of 0.980 or more is in a range of 16% by number to 30% by number.

3. The image forming apparatus according to claim 1, wherein the content ratio of toner particles having a particle diameter of 4.5 μm or more and less than 7.5 μm and a circularity of 0.980 or more is in a range 16% by number to 25% by number.

4. The image forming apparatus according to claim 1, wherein a content ratio of toner particles having a circularity of 0.900 or more and less than 0.950 is in a range of 5% by number to 15% by number with respect to the entirety of the toner particles, and a content ratio of toner particles having a circularity of 0.950 to 1.000 is in a range of 75% by number to 85% by number with respect to the entirety of the toner particles.

5. The image forming apparatus according to claim 4, wherein the content ratio of toner particles having a circularity of 0.900 or more and less than 0.950 is in a range of 10% by number to 15% by number with respect to the entirety of the toner particles.

6. The image forming apparatus according to claim 1, wherein the toner particles contain the crystalline polyester resin in a range of 1% by weight to 10% by weight with respect to the entirety of the binder resin.

7. The image forming apparatus according to claim 1, wherein a moving speed of a surface of the image holding member is 300 mm/s or more.

8. The image forming apparatus according to claim 1, wherein a distance in which a portion of the surface of the image holding member and a portion of the surface of the intermediate transfer member are disposed along with each other by the guide unit is in a range of 5 mm to 10 mm.

* * * * *